US011343885B2

(12) United States Patent
Fukuda

(10) Patent No.: US 11,343,885 B2
(45) Date of Patent: May 24, 2022

(54) LIGHT SOURCE DEVICE, LIGHTING CIRCUIT, AND DRIVING METHOD

(71) Applicant: Ushio Denki Kabushiki Kaisha, Tokyo (JP)

(72) Inventor: Minoru Fukuda, Tokyo (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/410,845

(22) Filed: Aug. 24, 2021

(65) Prior Publication Data

US 2022/0070981 A1 Mar. 3, 2022

(30) Foreign Application Priority Data

Sep. 1, 2020 (JP) ..... JP2020-146946

(51) Int. Cl.
*H05B 41/28* (2006.01)
*H05B 41/392* (2006.01)

(52) U.S. Cl.
CPC ..... *H05B 41/392* (2013.01)

(58) Field of Classification Search
CPC ..... H05B 41/2881; H05B 41/2858; H05B 41/2925; H05B 41/2928; H05B 45/325; H05B 45/385
See application file for complete search history.

(56) References Cited

U.S. PATENT DOCUMENTS 8,391,028 B2 * 3/2013 Yeh ..... H02M 3/33507 363/21.13
2009/0289557 A1 * 11/2009 Itoh ..... H05B 41/2886 315/127
2010/0033692 A1 * 2/2010 Watanabe ..... H05B 41/3925 353/85
2010/0134010 A1 * 6/2010 Asmussen ..... H05B 41/042 315/51
2012/0043899 A1 * 2/2012 Veskovic ..... H05B 41/295 315/200 R
2019/0149051 A1 * 5/2019 Claessens ..... H02M 1/15 315/200 R

FOREIGN PATENT DOCUMENTS

JP 2020-092968 A 6/2020

* cited by examiner

*Primary Examiner* — Tung X Le
(74) *Attorney, Agent, or Firm* — Studebaker & Brackett PC

(57) ABSTRACT

A light source device includes a light source unit having a dielectric barrier discharge lamp and a lighting circuit. The lighting circuit includes a transformer; a switching element; a controller for the switching element; a detector that detects current flowing through or voltage on a primary or a secondary side of the transformer; and a determination unit. The controller is configured to enable performing a steady-state operation of controlling ON/OFF of the switching element at a steady-state operation frequency (f1) to steadily light the dielectric barrier discharge lamp; and a determination operation of controlling ON/OFF of the switching element at a determination operation frequency (f2) higher than the steady-state operation frequency (f1), and the determination unit determines whether or not to stop the lighting operation based on the current or the voltage detected by the detector when the controller controls the switching element at the determination operation frequency (f2).

9 Claims, 8 Drawing Sheets

LIGHT SOURCE DEVICE, LIGHTING CIRCUIT, AND DRIVING METHOD

BACKGROUND OF THE INVENTION

Field of the Invention

The present invention relates to a light source device including a dielectric barrier discharge lamp, a lighting circuit, and a driving method.

Description of the Related Art

In recent years, a sterilization device using a lamp (for example, an excimer lamp) that emits ultraviolet light generated by dielectric barrier discharge has been known. This type of lamp emits light corresponding to the light-emitting gas enclosed inside a discharge container by generating a so-called dielectric barrier discharge with a pair of electrodes arranged with a light-emitting tube made of dielectric material interposed between them and is sometimes referred to as a dielectric barrier discharge lamp. In the case where krypton chloride (KrCl) is enclosed as the light-emitting gas, ultraviolet light having a single peak at a wavelength of 222 nm is generated, and in the case where krypton bromide (KrBr) is enclosed as the light-emitting gas, ultraviolet light having a single peak at a wavelength of 207 nm is generated.

This type of lamp is expected to be used as an ultraviolet light source that can inactivate microorganisms and viruses while suppressing their adverse effects on humans and animals, then expected to be used in various scenes such as medical facilities, schools, government offices, and other facilities where people frequently gather, as well as in vehicles such as cars, trains, buses, airplanes, and ships. Therefore, there is a strong need to develop smaller light source devices to meet these requirements.

PRIOR ART DOCUMENT

Patent Document

Patent Document 1: JP 2020-092968 A

SUMMARY OF THE INVENTION

Conventionally, a light source device equipped with a dielectric barrier discharge lamp includes a lighting circuit that applies voltage to a discharge container and discharges the light-emitting gas in the discharge container by driving the lighting circuit to generate ultraviolet light of 200 nm to 230 nm.

Specifically, the lighting circuit includes a transformer and a switching element provided on a primary side of the transformer. A light source unit with a dielectric barrier discharge lamp is provided on a secondary side of the transformer, and the voltage is applied to the light source unit provided on the secondary side of the transformer by driving the switching element. A fly-back circuit is a typical example of this circuit configuration.

However, if there is a defect in the electrical connection between the lighting circuit and the light source unit on the secondary side of the transformer, the resistance value will be maximized due to the non-connection of a circuit on the secondary side of the transformer, resulting in a high voltage on the secondary side of the transformer. This also affects the primary side of the transformer and increases the voltage value on also the primary side of the transformer. As a result, an excessive voltage is applied to the switching element, which may cause damage to the switching element in some cases.

Given the above problem, the present invention provides a device configuration and a driving method that can appropriately avoid the application of an excessive voltage to a switching element in a light source device including a dielectric barrier discharge lamp or in a lighting circuit of the dielectric barrier discharge lamp.

A light source device according to the present invention includes: a light source unit including a dielectric barrier discharge lamp; and a lighting circuit that supplies power to the light source unit, the lighting circuit including a transformer; a power supply circuit connected to a primary side of the transformer; a switching element; a controller for the switching element; a detector that detects current flowing through or voltage on the primary side or a secondary side of the transformer; and a determination unit that determines whether or not to stop a lighting operation of the dielectric barrier discharge lamp, wherein the lighting circuit is configured to supply power to the light source unit arranged on the secondary side of the transformer by operation of the switching element, the controller is configured to enable performing a steady-state operation of controlling ON/OFF of the switching element at a steady-state operation frequency f1 to steadily light the dielectric barrier discharge lamp; and a determination operation of controlling ON/OFF of the switching element at a determination operation frequency f2 higher than the steady-state operation frequency f1, and the determination unit determines whether or not to stop the lighting operation based on the current or the voltage detected by the detector when the controller controls the switching element at the determination operation frequency f2.

The light source device of the present invention described above makes it possible for the detector to determine the connection state between the light source unit and the lighting circuit even when the light source unit including the dielectric barrier discharge lamp is not appropriately connected to the lighting circuit, thus avoiding the application of an excessive voltage to the switching element provided in the lighting circuit.

The detector may be connected to the secondary side of the transformer. Further, the detector may be connected to a low-voltage side of the light source unit on a secondary side of the transformer.

Still, the determination unit may have a determination reference value for determining whether the lighting operation is normal, and may output a stop signal to the controller in the case a detection value from the detector does not exceed the determination reference value within a predetermined time.

A lighting circuit of a dielectric barrier discharge lamp according to the present invention includes: a transformer; a power supply circuit connected to a primary side of the transformer; a switching element; a controller for the switching element; a detector that detects current flowing through or voltage on the primary side or a secondary side of the transformer; and a determination unit that determines whether or not to stop a lighting operation of the dielectric barrier discharge lamp, wherein the lighting circuit is configured to supply power to the secondary side of the transformer connected to the dielectric barrier discharge lamp by operation of the switching element, the controller is configured to enable performing a steady-state operation of controlling ON/OFF of the switching element at a steady-state operation frequency f1 to steadily light the dielectric barrier discharge lamp; and a determination operation of controlling ON/OFF of the switching element at a determination operation frequency f2 higher than the steady-state operation frequency f1, and the determination unit determines whether or not to stop the lighting operation based on the current or the voltage detected by the detector when the controller controls the switching element at the determination operation frequency f2.

The lighting circuit of the dielectric barrier discharge lamp of the present invention described above makes it possible for the detector to determine the connection state between the light source unit and the lighting circuit even when an electrical interruption occurs on the secondary side of the transformer to which the dielectric barrier discharge lamp is connected, thus avoiding the application of an excessive voltage to the switching element provided in the lighting circuit.

The detector may be connected to the secondary side of the transformer. Further, the detector may be connected to a low-voltage side on a secondary side of the transformer.

Still, the determination unit may have a determination reference value for determining whether the lighting operation is normal, and may output a stop signal to the controller in the case a detection value from the detector does not exceed the determination reference value within a predetermined time.

A driving method for lighting a dielectric barrier discharge lamp according to the present invention includes:

preparing a lighting circuit that includes a transformer; a power supply circuit connected to a primary side of the transformer; a switching element; and a controller for the switching element, and that is configured to supply power to a secondary side of the transformer connected to the dielectric barrier discharge lamp by operation of the switching element, performing a steady-state operation of controlling ON/OFF of the switching element at a steady-state operation frequency f1 to steadily light the dielectric barrier discharge lamp; and a determination operation of controlling ON/OFF of the switching element at a determination operation frequency f2 higher than the steady-state operation frequency f1 before the steady-state operation, and determining whether or not to stop the lighting operation based on the current or the voltage detected by the detector when the controller controls the switching element at the determination operation frequency f2.

The driving method for lighting a dielectric barrier discharge lamp of the present invention described above makes it possible to determine the connection state on the secondary side of the transformer even when an electrical interruption occurs on the secondary side of the transformer to which the dielectric barrier discharge lamp is connected, thus avoiding the application of an excessive voltage to the switching element by determining to stop the lighting operation based on this determination.

According to one aspect of the present invention, it is possible to provide a device configuration, a lighting circuit, and a driving method that can appropriately avoid application of an excessive voltage to the switching element in the lighting circuit of the dielectric barrier discharge lamp.

DETAILED DESCRIPTION OF THE PREFERRED EMBODIMENTS

Figure 1:
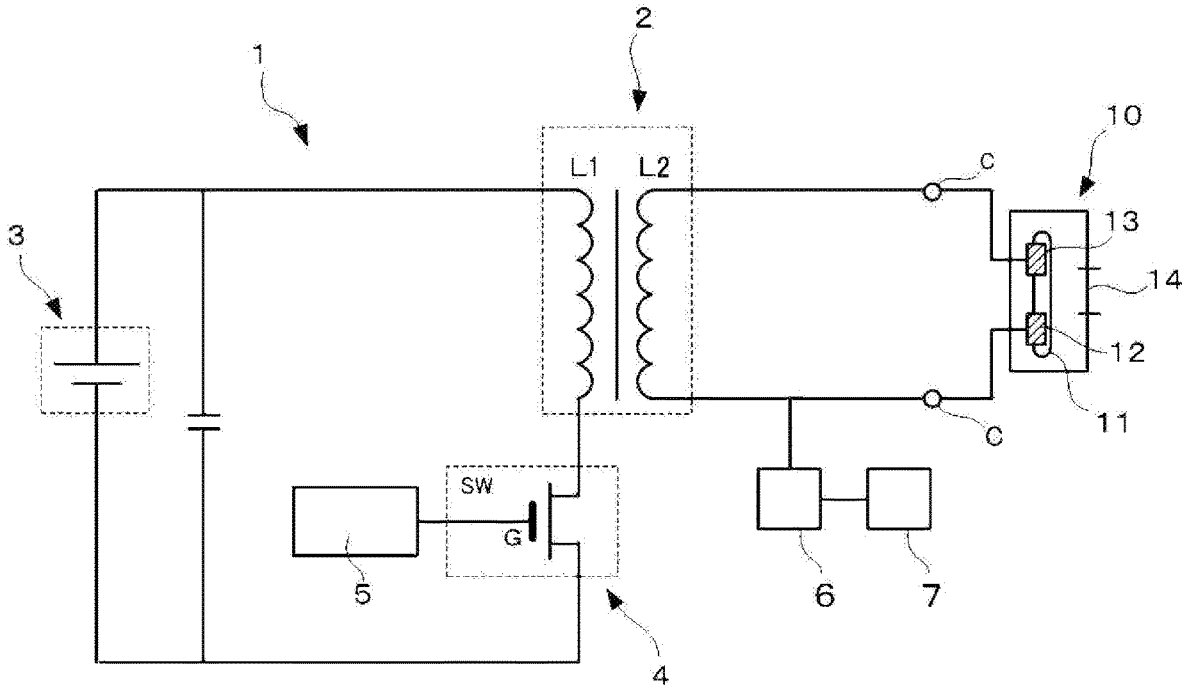
FIG. 1 is a diagram exemplifying a lighting circuit of a light source device according to the present invention.

FIG. 1 is a diagram exemplifying a lighting circuit 1 of a light source device according to the present invention. A light source unit 10 includes a dielectric barrier discharge lamp 11 (hereinafter, also simply referred to as a "lamp") in a housing, and a first electrode 12 and a second electrode 13 are attached to both end sides of the lamp. Both electrodes (the first and the second electrodes) are electrically connected to a secondary winding L2 of a transformer 2 via a connector C extending outside the housing.

A power supply circuit 3 to which power is supplied from a commercial power supply or a DC power supply is connected to a primary winding L1 of the transformer 2. A switching element 4 such as an FET element is connected to the other end of the primary winding of the transformer 2, and a control circuit 5 is connected to a gate G of the switching element 4. The control circuit 5 is generally called a boost fly-back circuit, and a pulse-shaped voltage waveform is generated on the secondary side of the transformer 2 corresponding to the off timing of the switching element 4 provided on the primary side of the transformer 2. Such a circuit configuration is generally referred to as a fly-back circuit.

The lighting circuit 1 is provided with a detector 6 that detects a current flowing through or a voltage on the secondary side of the transformer. As a result, when the current flows through (or when the voltage is applied to) the light source unit 10 connected to the secondary side, a predetermined current value or voltage value can be detected by the detector 6, whereby conduction and non-conduction of the light source unit 10 can be identified.

In FIG. 1, the detector is provided on the secondary side of the transformer 2, and for example, the detector 6 is provided on the low-voltage side on the secondary side. Here, the detector 6 may be provided on the high-voltage side on the secondary side. However, from the viewpoint of suppressing the voltage load on the detector 6, the detector 6 is desirably provided on the low-voltage side. In addition, the detector 6 may be provided on the primary side of the transformer 2 as well, but since the current fluctuates more on the secondary side of the transformer 2, there is an advantage that the detection operation by the detector 6 is easier provided on the secondary side of the transformer 2.

Figure 2A:
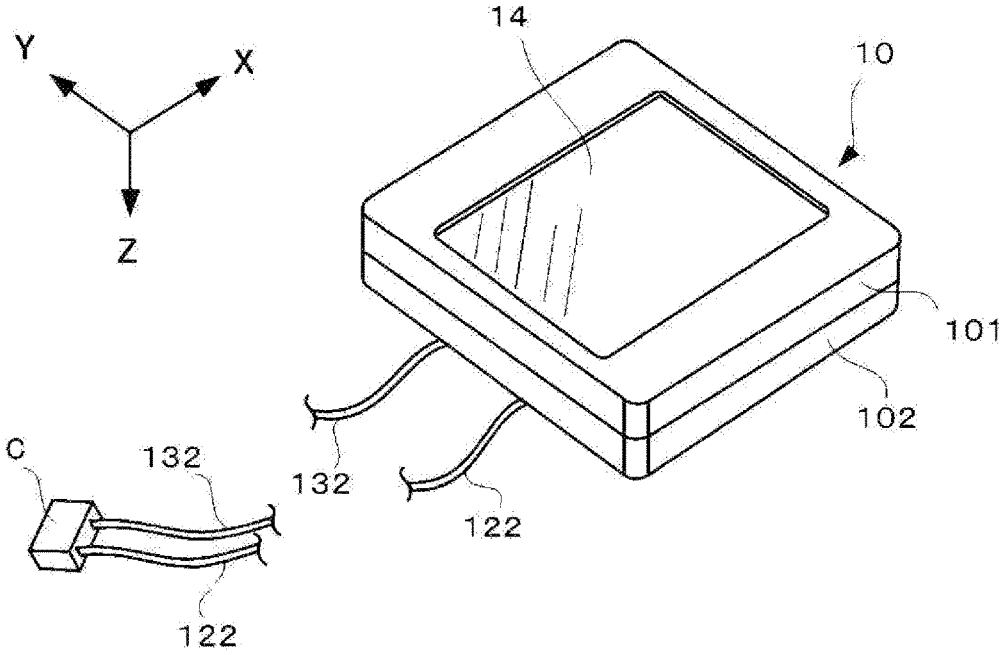
FIGS. 2A and 2B are diagrams exemplifying an external view of one aspect of a light source unit according to the present invention.
Figure 2B:
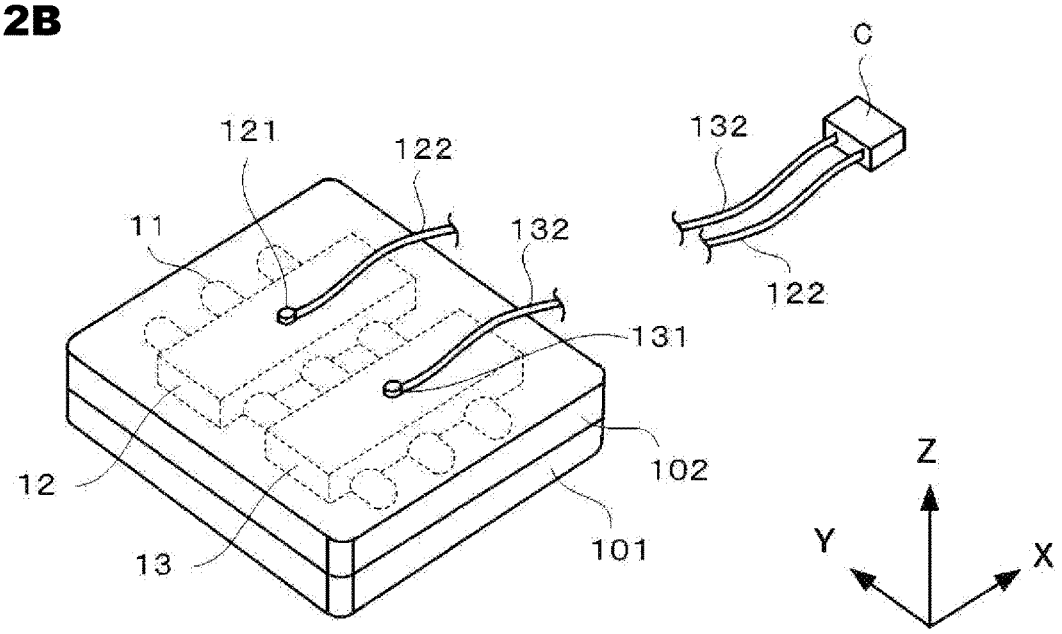

FIGS. 2A and 2B exemplify external views of one aspect of the light source unit according to the present invention. FIG. 2A illustrates a front surface side (a light-emitting surface side) of the light source unit, and FIG. 2B illustrates a back surface side of the light source unit. In the light source unit 10, a plurality of dielectric barrier discharge lamps 11 is mounted in a housing including an upper frame 101 and a lower frame 102. A pair of electrodes, the first electrode 12 and the second electrode 13, are provided in the housing, and the dielectric barrier discharge lamps 11 are installed straddling across both electrodes. In this example, each of the electrodes (12,13) is made of a block-shaped metal body (an electrode block), and the electrode block has grooves to match an outer tube shape of the dielectric barrier discharge lamps 11.

In addition, the light source unit 10 is provided with a light-emitting surface 14, and a window member is exemplarily placed on it. Ultraviolet light is emitted from the light-emitting surface 14 to inactivate microorganisms and viruses present in the space or on the object's surface. Note that the light-emitting surface 14 can be equipped with an optical filter to cut harmful light. The optical filter can be, for example, a wavelength selection filter that transmits light in the wavelength range of 190 nm to 237 nm (more preferably, light in the wavelength range of 190 nm to 230 nm) with fewer adverse effects on the human body, and cuts light in other UVC wavelength ranges.

As shown in FIG. 2B, the light source unit 10 is provided with a first connection terminal 121 electrically connected to the first electrode 12 and a second connection terminal 131 electrically connected to the second electrode 13, which penetrate the housing and are connected to conductive wires (122, 132), respectively. The conductive wires are connected to the secondary side of the transformer 2 (the secondary winding L2 of the transformer 2) via the connector C. Power is supplied from the power supply circuit 3 provided in the lighting circuit to the light source unit 10 via the transformer 2.

As illustrated in FIGS. 2A and 2B, the light source unit 10 accommodates the pair of electrodes (12, 13) and a predetermined number of the dielectric barrier discharge lamps 11 inside the housing, and the entire housing is designed to be compact. Further, the conductive wires (122, 132) extend outside the housing and are electrically connected to the lighting circuit 1 provided outside the housing via the connector C. This configuration allows the light source unit 10 to be detachable from the lighting circuit 1. For example, when the lamp 11 being accommodated in the light source unit 10 reaches the end of its lighting life, or when a problem with the lamp 11 occurs during lighting, this configuration allows for lamp replacement by replacing only the light source unit 10, which is highly convenient for the user.

However, if the light source unit 10 is not connected to the lighting circuit 1 during the performance of the lighting operation, the secondary side of the transformer 2 has a higher voltage than if the light source unit 10 is connected thereto. This also affects the primary side of the transformer 2, and a voltage on the primary side of the transformer 2 increases, which may apply an excessive load to the switching element 4. This may, in some cases, damage the switching element 4 itself causing the light source device 10 itself to malfunction.

Such a problem is likely to occur in the case that the first electrode 12 and the second electrode 13 are non-conductive, for example, if the connector C on the light source unit 10 is not appropriately connected to the lighting circuit 1, if the dielectric barrier discharge lamp 11 accommodated in the light source unit 10 is detached from the electrode (12, 13), or if the dielectric barrier discharge lamp 11 accommodated in the light source unit 10 is damaged by impact, or the like. In particular, a problem caused by the impact is likely to become apparent where the light source device is installed in a vehicle.

In the present invention, the detector 6 is provided to prevent an excessive load from being applied to the switching element 4 due to the above-described conduction failure. For example, the lighting circuit 1 is provided with the detector 6, and the detector 6 monitors a value of the current flowing through or the voltage on the primary side or the secondary side of the transformer 2. In the case where the conduction of the light source unit 10 is ensured, a pulse voltage is applied to the secondary side of the transformer 2 in accordance with ON/OFF driving of the switching element 4, and the current flows to the secondary side of the transformer 2 accordingly. However, in the case where the conduction of the light source unit 10 is not ensured (non-conductive), a predetermined current does not flow to the secondary side of the transformer 2, and a high voltage is applied. Therefore, a detection voltage Vf is generated from the current or the voltage detected by the detector 6 and is transmitted to a determination unit 7. Based on a value of the detection voltage Vf, the determination unit 7 determines whether the light source unit 10 has a conduction failure and sends a determination signal S to the controller 5. The controller 5 stops the ON/OFF operation of the switching element 4 based on the determination signal S, which allows the light source device to be stopped before an excessive load is applied to the switching element 4.

Figure 3A:
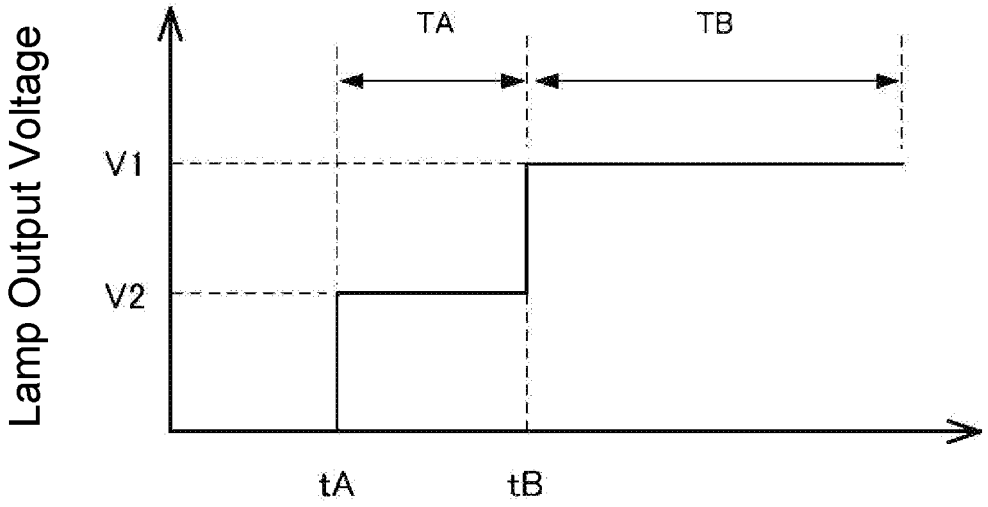
FIGS. 3A and 3B are explanatory views for explaining an aspect of a lighting operation according to the present invention.
Figure 3B:
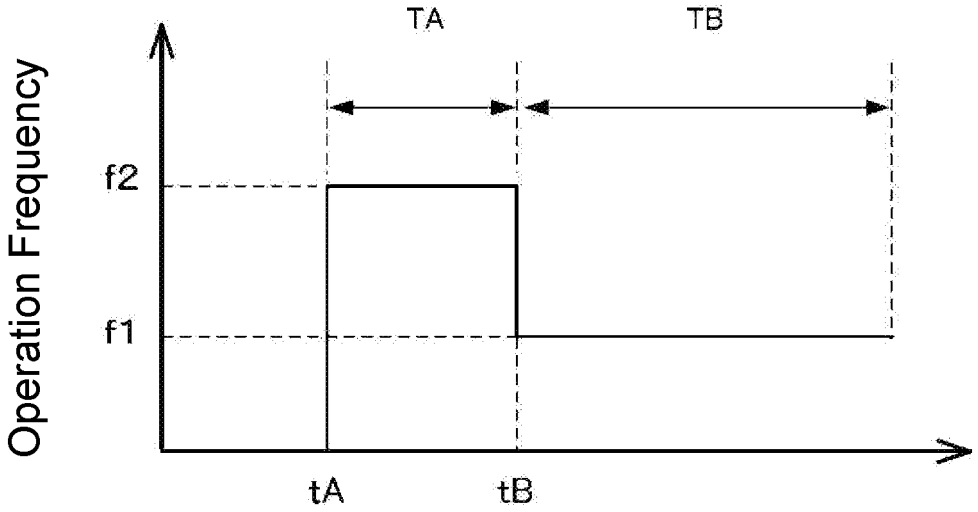

FIGS. 3A and 3B illustrate graphs for explaining an aspect of the lighting operation according to the present invention. FIG. 3A illustrates a change in an output voltage (a lamp output voltage) to the dielectric barrier discharge lamp connected to the secondary side of the transformer 2. FIG. 3B illustrates a change in an operation frequency of the transformer 2.

It is necessary to determine whether the conduction failure is occurring in the light source unit 10 at a time when the lamp output voltage to the dielectric barrier discharge lamp 11 is low. This is because the determination must be made before an excessive voltage load is applied to the switching element 4. Therefore, in the lighting operation according to the present invention, a determination operation period TA is provided in which the lamp output voltage maintains a voltage V2 lower than that during steady-state lighting. This makes it possible to determine whether the conduction failure is occurring in light source unit 10 from the value of the generated detection voltage Vf based on the current or the voltage detected by the detector 6 while avoiding an excessive voltage load on the switching element 4. If no problem is confirmed during the determination operation period TA, the dielectric barrier discharge lamp 11 can be turned on steadily by shifting to a steady-state operation period TB.

FIG. 3B illustrates a change in the operation frequency of the transformer 2 during the determination operation period TA and the steady-state operation period TB. As illustrated in the drawing, an operation frequency f2 of the transformer 2 in the determination operation period TA is controlled to be higher than an operation frequency f1 of the transformer 2 in the steady-state operation period TB. The operation frequency of the transformer 2 here is determined by an ON/OFF cycle of the switching element 4. Thus, by setting the operation frequency f2 in the determination operation period TA to a high value, a voltage peak applied to the transformer 2 is suppressed low.

In this manner, by controlling the operation frequency of the transformer 2 to be higher between a determination operation start time to and a steady-state operation start time tB, the determination unit 7 performs the determination operation such that load is prevented from being applied to the switching element 4.

In the present invention, the operation frequency f1 of the transformer 2 in the steady-state operation is referred to as a steady-state operation frequency, and the operation frequency f2 of the transformer 2 in the determination operation is referred to as a determination operation frequency.

Figure 4:
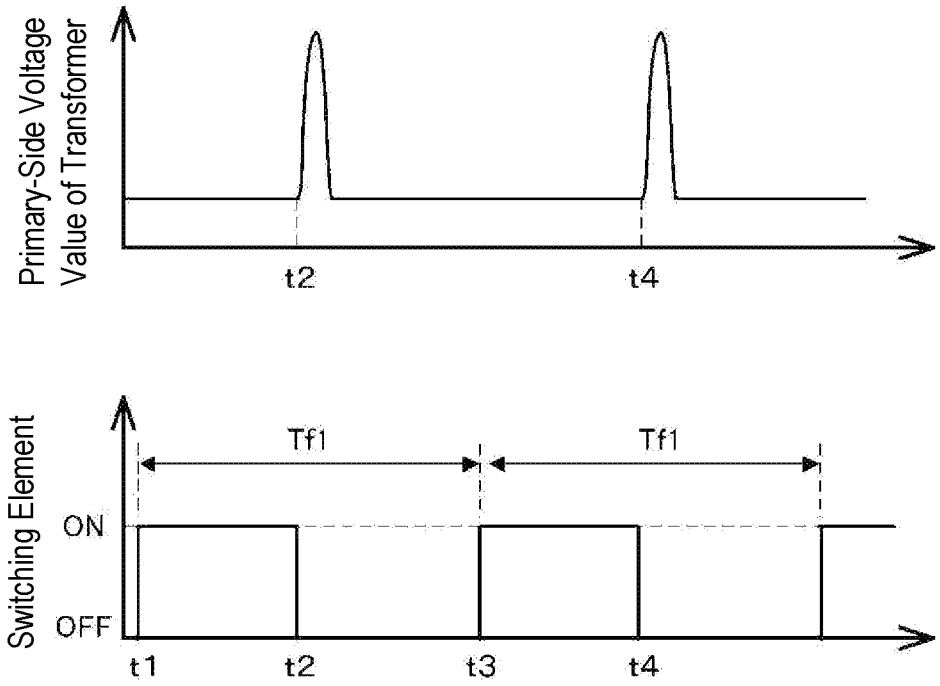
FIG. 4 is an explanatory view for explaining an aspect of a steady-state operation according to the present invention.

FIG. 4 is an explanatory diagram conceptually illustrating a voltage change on the primary side of the transformer 2 (the primary winding L1) and the ON/OFF driving of the switching element 4 in the steady-state operation period TB. The steady-state operation frequency f1 in the steady-state operation period TB is determined so that a predetermined lamp output voltage for turning on the dielectric barrier discharge lamp 11 is applied, and thus an ON/OFF operation period Tf1 of the switching element 4 is determined. As a result, a pulse voltage is applied to the secondary side of the transformer 2, and the lamp is turned on.

Figure 5:
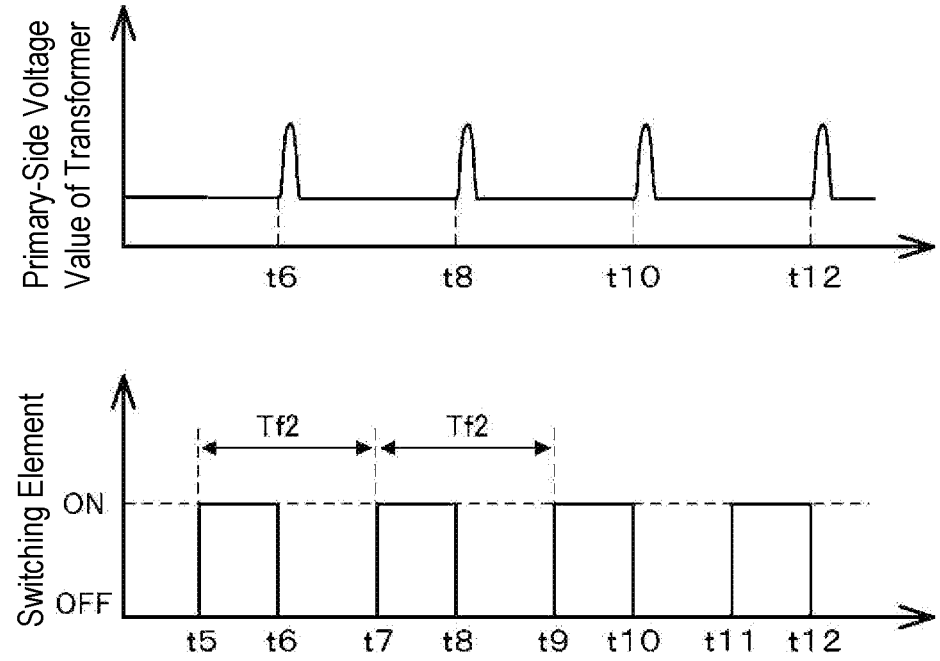
FIG. 5 is an explanatory view for explaining an aspect of a determination operation according to the present invention.

FIG. 5 is an explanatory diagram conceptually illustrating a voltage change on the primary side of the transformer 2 (the primary winding L1) and the ON/OFF driving of the switching element 4 in the determination operation period TA. The determination operation frequency f2 in the determination operation period TA is set to an operation frequency higher than the steady-state operation frequency f1, for example, 1.2 times or more than the steady-state operation frequency f1. As a result, the voltage peak applied to the transformer 2 is suppressed low, and the voltage load on the switching element 4 is reduced.

Figure 6:
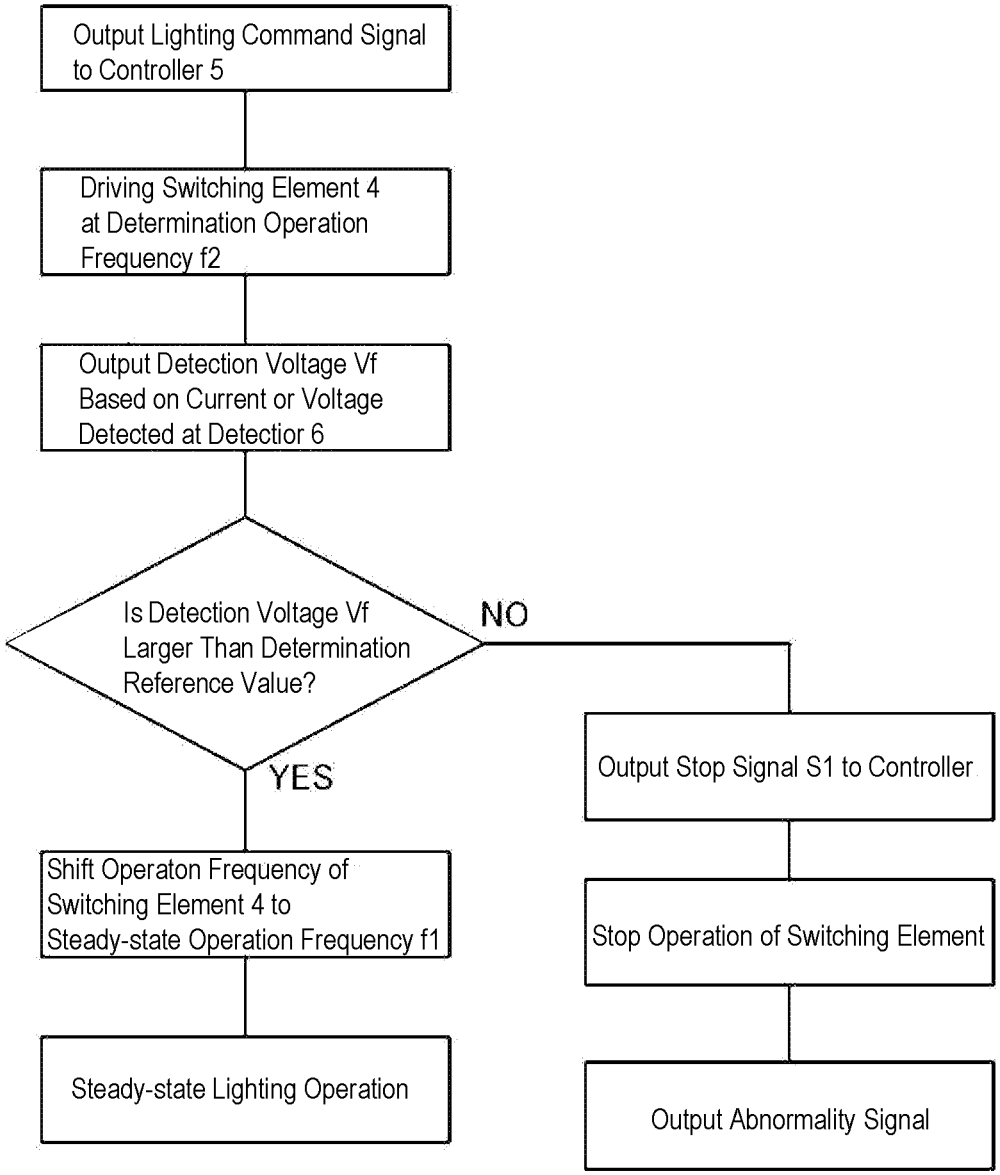
FIG. 6 is a flowchart for explaining an aspect of the lighting operation according to the present invention.

FIG. 6 is a flowchart for explaining an aspect of the lighting operation according to the present invention.

First, when a lighting command signal is output to the controller 5, the ON/OFF operation of the switching element 4 is started. The operation frequency of the switching element 4 is at this time is the determination operation frequency f2, which is higher than the operation frequency in the steady-state. During driving at the determination operation frequency f2, the detection voltage Vf is output to the determination unit 7 based on the current or the voltage detected by the detector 6. The determination unit 7 checks whether the output detection voltage Vf reaches a preset determination reference value, and outputs a determination signal S to the controller 5. If the detection voltage Vf does not reach the determination reference value, a stop signal S1 is output to the controller 5. After receiving the stop signal S1, the controller 5 controls the switching element 4 to stop its operation. Thereafter, an abnormality signal is output to notify that an error has occurred. On the other hand, if the detection voltage Vf reaches the determination reference value, the operation frequency of the switching element 4 is shifted to the steady-state operation frequency f1, and the steady-state lighting operation of the lamp is executed.

The dielectric barrier discharge lamp 11 according to the present invention is, for example, an excimer lamp in which a rare gas and halogen are sealed as a light-emitting gas. In the configuration according to the present invention, a pulse voltage from the lighting circuit 1 is applied to the excimer lamp, thereby forming an excited dimer (exciplex) of the light-emitting gas, which is rare gas and halogen, thus emitting excimer light specific to the light-emitting gas.

The electrodes (12, 13) shown in FIG. 2B are arranged at one end side or the other of the dielectric barrier discharge lamp 11, but the form of the electrodes (12, 13) is not limited thereto. For example, structures may be adopted, in which a pair of long belt-shaped electrodes are arranged in the short-side direction of the light-emitting tube, or only one electrode is arranged in the light-emitting tube.

In the case of using the light source device of the present invention as the sterilization device, the light source device is preferably a lamp that emits so-called UVC light or vacuum ultraviolet light. A numerical example of the light-emitting tube provided by the lamp 11 is 40 mm in length and 5 mm in outer diameter φ.

Figure 7:
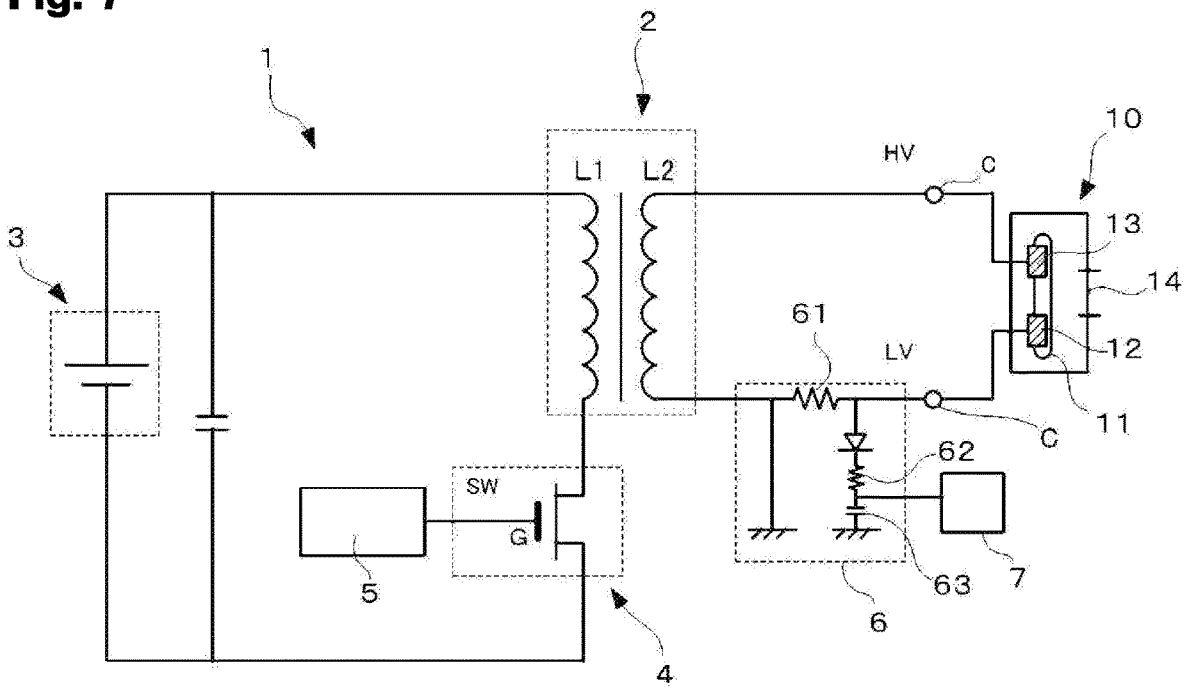
FIG. 7 is a diagram illustrating an example of the lighting circuit according to the present invention.

FIG. 7 is a diagram illustrating an example of the lighting circuit according to the present invention, and the lighting circuit has a configuration in which the detector 6 is attached to the low-voltage side LV on the secondary side of the transformer 2. In the present example, the current flowing through the secondary side of the transformer 2 is detected.

The detector 6 is provided with a current detection resistor 61 that converts the current flowing through the secondary side of the transformer 2 into a voltage value, a current limiting resistor 62 connected to the current detection resistor 61 via a diode, and a capacitor 63, and outputs a voltage (the detection voltage Vf) between the current limiting resistor 62 and the capacitor 63 to the determination unit 7. The determination unit 7 is provided with a comparator circuit (not illustrated), which compares the detection voltage Vf with a preset determination reference voltage, and outputs the stop signal S1 to the controller 5 if the detection voltage Vf does not reach the determination reference voltage in a predetermined time.

Figure 8:
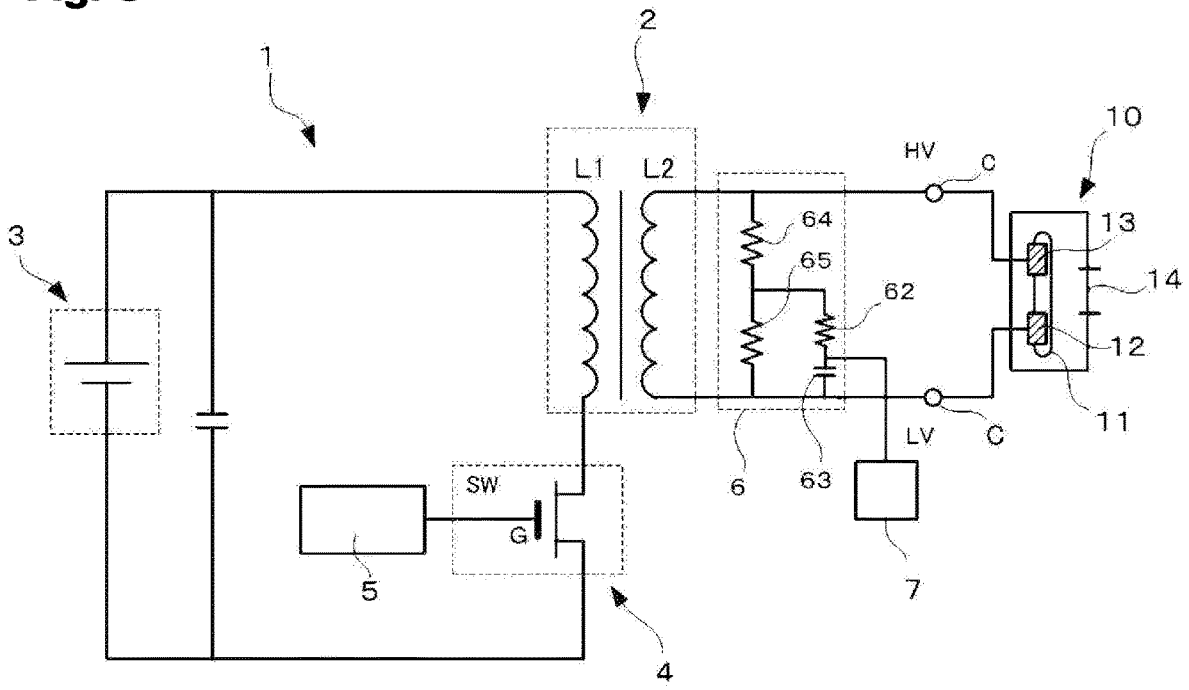
FIG. 8 is a diagram illustrating an example of the lighting circuit according to the present invention.

FIG. 8 is a diagram illustrating another example of the lighting circuit according to the present invention. Here, on the secondary side of the transformer 2, the detector 6 is installed to detect a voltage between a high-voltage side HV and the low-voltage side LV. A high resistance element 64 corresponding to the high-voltage side and a low resistance element 65 corresponding to the low-voltage side are provided, and the detection voltage Vf is generated from the current flowing through the resistor 62 by the potential difference applied to the secondary side of the transformer 2 and output to the determination unit 7. If the detection voltage Vf exceeds the determination reference value, the determination unit 7 determines that the secondary side of the transformer 2 is non-conductive, and outputs the stop signal S1 to the controller 5.

Figure 9:
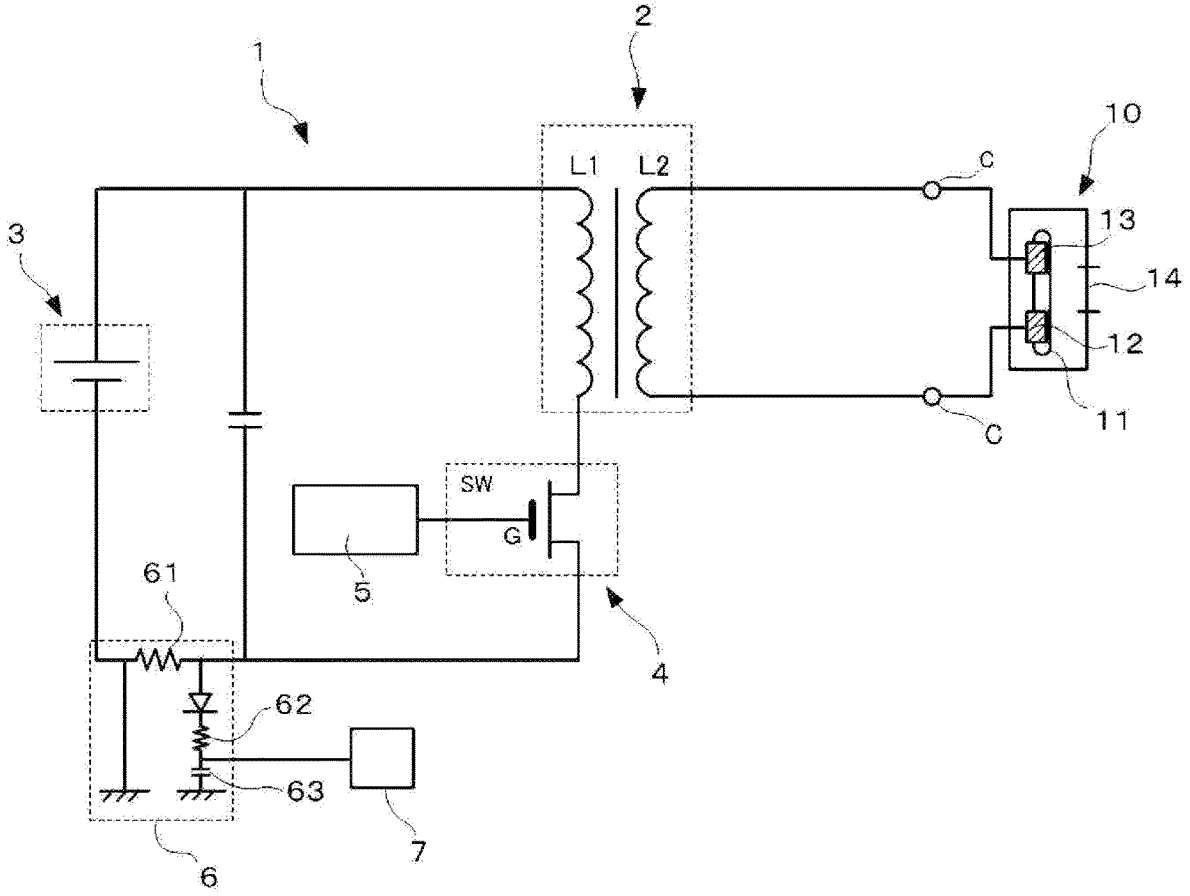
FIG. 9 is a diagram illustrating an example of the lighting circuit according to the present invention.

FIG. 9 is a diagram illustrating another example of the lighting circuit according to the present invention. Here, the detector 6 is provided on the primary side of the transformer 2 to detect the current flowing through the lighting circuit. The detector 6 is configured by, for example, including the current detection resistor 61, the current limiting resistor 62 connected to the current detection resistor 61 via a diode, and the capacitor 63. The detector 6 outputs a voltage (the detection voltage Vf) between the resistor 62 and the capacitor 63 to the determination unit 7. If the detection voltage Vf does not exceed the determination reference value in a predetermined time, the determination unit 7 determines that the secondary side of the transformer 2 is non-conductive, and outputs the stop signal S1 to the controller 5.

Figure 10:
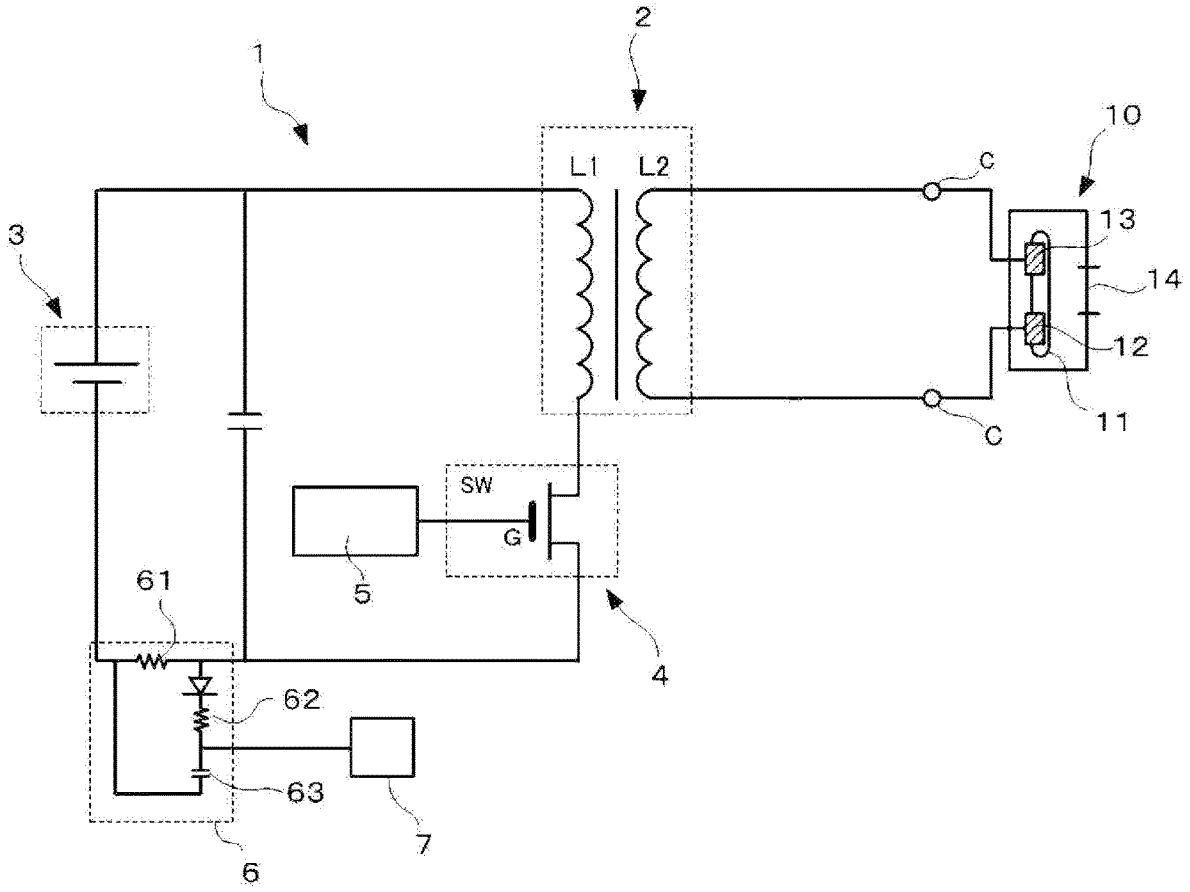
FIG. 10 is a diagram illustrating an example of the lighting circuit according to the present invention.

FIG. 10 is a diagram illustrating another example of the lighting circuit according to the present invention. Here, the detector 6 is provided on the primary side of the transformer 2 to detect the current flowing through the lighting circuit. The detector 6 is configured by, for example, including the current detection resistor 61, the current limiting resistor 62 connected to the current detection resistor 61 via a diode, and the capacitor 63. The detector 6 outputs a voltage (detection voltage Vf) between the resistor 62 and the capacitor 63 to the determination unit 7. If the detection voltage Vf does not exceed the determination reference value in a predetermined time, the determination unit 7 determines that the secondary side of the transformer 2 is non-conductive, and outputs the stop signal S1 to the controller 5.

In the present invention, a fly-back circuit is adopted as the lighting circuit 1. In general, a lighting device for an excimer lamp often supplies a sinusoidal wave or a rectangular pulse wave to the lamp, but in the present invention, oscillating waveforms are supplied by the fly-back circuit. This is because a conventionally known excimer lamp generally has a large total length of 300 mm or more, and application of a relatively high voltage is required to favorably generate discharge between electrodes. On the other hand, since the light source device according to the present invention is also supposed to be mounted on vehicles, lighting fixtures, or the like, it is downsized as a light source device. This is because, for example, in sterilization and inactivation applications, there is a strong demand for downsizing and weight reduction of the light source device. Therefore, also in the light source unit 10 illustrated in FIG. 2, a dielectric barrier discharge lamp 11 (an excimer lamp) having a relatively small total length of 100 mm or less is adopted, and in this case, it is desirable to adopt a fly-back lighting circuit as a lighting circuit 1.

What is claimed is:

1. A light source device comprising:

a light source unit including a dielectric barrier discharge lamp; and a lighting circuit that supplies power to the light source unit, the lighting circuit including a transformer; a power supply circuit connected to a primary side of the transformer; a switching element; a controller for the switching element; a detector that detects current flowing through or voltage on the primary side or a secondary side of the transformer; and a determination unit that determines whether or not to stop a lighting operation of the dielectric barrier discharge lamp, wherein the lighting circuit is configured to supply power to the light source unit arranged on the secondary side of the transformer by operation of the switching element, the controller is configured to enable performing a steady-state operation of controlling ON/OFF of the switching element at a steady-state operation frequency (f1) to steadily light the dielectric barrier discharge lamp; and a determination operation of controlling ON/OFF of the switching element at a determination operation frequency (f2) higher than the steady-state operation frequency (f1), and the determination unit determines whether or not to stop the lighting operation based on the current or the voltage detected by the detector when the controller controls the switching element at the determination operation frequency (f2).

2. The light source device according to claim 1, wherein the detector is connected to the secondary side of the transformer.

3. The light source device according to claim 2, wherein the detector is connected to a low-voltage side of the light source unit.

4. The light source device according to claim 1, wherein the determination unit has a determination reference value for determining whether the lighting operation is normal, and the determination unit outputs a stop signal to the controller in the case a detection value from the detector does not exceed the determination reference value within a predetermined time.

5. A lighting circuit for a dielectric barrier discharge lamp, the lighting circuit comprising:

a transformer;

a power supply circuit connected to a primary side of the transformer;

a switching element;

a controller for the switching element;

a detector that detects current flowing through or voltage on the primary side or a secondary side of the transformer; and a determination unit that determines whether or not to stop a lighting operation of the dielectric barrier discharge lamp, wherein the lighting circuit is configured to supply power to the secondary side of the transformer connected to the dielectric barrier discharge lamp by operation of the switching element, the controller is configured to enable performing a steady-state operation of controlling ON/OFF of the switching element at a steady-state operation frequency (f1) to steadily light the dielectric barrier discharge lamp; and a determination operation of controlling ON/OFF of the switching element at a determination operation frequency (f2) higher than the steady-state operation frequency (f1), and the determination unit determines whether or not to stop the lighting operation based on the current or the voltage detected by the detector when the controller controls the switching element at the determination operation frequency (f2).

6. The lighting circuit according to claim 5, wherein the detector is connected to the secondary side of the transformer.

7. The lighting circuit according to claim 6, wherein the detector is connected to a low-voltage side of the light source unit.

8. The lighting circuit according to claim 5, wherein the determination unit has a determination reference value for determining whether the lighting operation is normal, and the determination unit outputs a stop signal to the controller in the case a detection value from the detector does not exceed the determination reference value within a predetermined time.

9. A driving method for lighting a dielectric barrier discharge lamp comprising:

preparing a lighting circuit that includes a transformer; a power supply circuit connected to a primary side of the transformer; a switching element; and a controller for the switching element, and that is configured to supply power to a secondary side of the transformer connected to the dielectric barrier discharge lamp by operation of the switching element, performing a steady-state operation of controlling ON/OFF of the switching element at a steady-state operation frequency (f1) to steadily light the dielectric barrier discharge lamp; and a determination operation of controlling ON/OFF of the switching element at a determination operation frequency (f2) higher than the steady-state operation frequency (f1) before the steady-state operation, and determining whether or not to stop the lighting operation based on the current or the voltage detected by the detector when the controller controls the switching element at the determination operation frequency (f2).

* * * * *